United States Patent [19]

Masino

[11] Patent Number: 4,519,282

[45] Date of Patent: May 28, 1985

[54] METHOD FOR BOXING BUBBLE STRIPS

[75] Inventor: Leo Masino, Karlsruhe, Fed. Rep. of Germany

[73] Assignee: E. Th. Noack Verpackungsmaschinen, Karlsruhe, Fed. Rep. of Germany

[21] Appl. No.: 384,382

[22] Filed: Jun. 2, 1982

[30] Foreign Application Priority Data

Jun. 4, 1981 [DE] Fed. Rep. of Germany ..... 3122271

[51] Int. Cl.[3] ..... B26D 7/32

[52] U.S. Cl. ..... 83/85; 53/520; 53/544; 83/78; 414/30

[58] Field of Search ..... 53/427, 446, 447, 544, 53/591, 520; 414/30, 31, 55, 56, 105; 206/461; 83/78, 85, 86, 88; 198/408, 420

[56] References Cited

U.S. PATENT DOCUMENTS

| | | | |
|---|---|---|---|
| 3,143,223 | 8/1964 | McIntyre | 53/544 X |
| 3,187,889 | 6/1965 | Sinclair | 206/461 X |
| 3,307,693 | 3/1967 | Bittner | 206/461 |
| 3,737,029 | 6/1973 | Serrell | 206/461 |

FOREIGN PATENT DOCUMENTS

| | | | |
|---|---|---|---|
| 2923106 | 12/1980 | Fed. Rep. of Germany | 206/461 |
| 3014896 | 7/1981 | Fed. Rep. of Germany | 53/427 |
| 1327082 | 4/1963 | France | 53/397 |

*Primary Examiner*—John Sipos

*Attorney, Agent, or Firm*—Spencer & Frank

[57] ABSTRACT

Method for assembling identical bubble strips each containing a plurality of individually packaged products disposed at regular intervals along the strip and protruding transversely from one side of the strip, by the steps of orienting two of the strips relative to one another such that the packaged products on each strip protrude toward the other strip and the packaged products on one strip are offset from the packaged products on the other strip, and pushing the strips toward one another such that the products of one strip are adjacent those of the other strip and the strips are nested together.

2 Claims, 5 Drawing Figures

METHOD FOR BOXING BUBBLE STRIPS

BACKGROUND OF THE INVENTION

The present invention relates to systems in which pills and similar products of the most varied shapes can be individually packaged in deep-drawn foils. A certain number of these individually packaged pills, usually one or a plurality of rows, form a bubble strip. These bubble strips are packed into boxes in a boxing machine or are manually placed in boxes.

It has been the custom to place the bubble strips on top of one another in the boxes so that the box height was always equal to the number of superposed bubble strips multiplied by the individual height of each strip. This meant that unused free space existed between the pills.

SUMMARY OF THE INVENTION

It is an object of the invention to achieve space-saving boxing of bubble strips.

The above and other objects of the invention are achieved by a method for packaging bubble strips containing circular tablets, pills, capsules, oblong tablets or similar products, by nesting two such bubble strips before they are boxed. This is done by rotating one of the strips by 180° with respect to the other, shifting the strips relative to one another by a predetermined amount and then pushing them into one another.

This process has the advantage that the overall height of the two nested bubble strips is hardly more than the height of an individual bubble strip. The increase in length or width of the two nested bubble strips is no more than about one-half that of an individual package. The boxes are thus packed much more tightly than before which results in a saving of material and space.

It is advantageous to construct the packaging machines for carrying out the method of the invention so that the two bubble strips are cut out of a foil band during the same process step by two mutually offset cutting units and are then subjected to rotation and pushed into one another, i.e. nested, by a transporting device which operates with a timed advance.

During packaging of bubble strips containing capsules, oblong pills or other products having an elongate shape, the present invention provides that each elongate product is packaged with its length generally normal to the length of the strip and then two such bubble strips are nested by being displaced against one another in their longitudinal direction by one half the dimension of a package for a single product in the longitudinal direction of the strip, e.g. by guide sheets, before they are subjected to rotation and pushed into one another. The two nested bubble strips then take up approximately the original height and width of a single bubble strip while they are longer by only one-half a single package than an individual strip. The saving in space is thus almost 50%.

During packaging of bubble strips containing pills, round tablets or products having a similar shape, the two bubble strips are shifted with respect to one another to the strip length by a distance equal to about one-half to a full package dimension before they are subjected to rotation and pushed into one another. The two nested bubble strips then take up approximately the height and length of a single bubble strip while they are wider by about one-half a package dimension than the individual strip. Here also the saving in space is considerable.

According to a further feature of the invention, the bubble strips, before being put into boxes, pass through an apparatus in which those bubble strips which have been checked after filling and found to be incompletely filled are rejected as a nested pair, e.g. through a flap.

One embodiment of the invention will be described in greater detail below with the aid of FIGS. 1 through 3.

FIGS. *2a*, *2b* and *3a*, *3b* are plan and side elevational views of two embodiments of nested bubble strips formed according to the invention.

DESCRIPTION OF THE PREFERRED EMBODIMENTS

Figure 1:
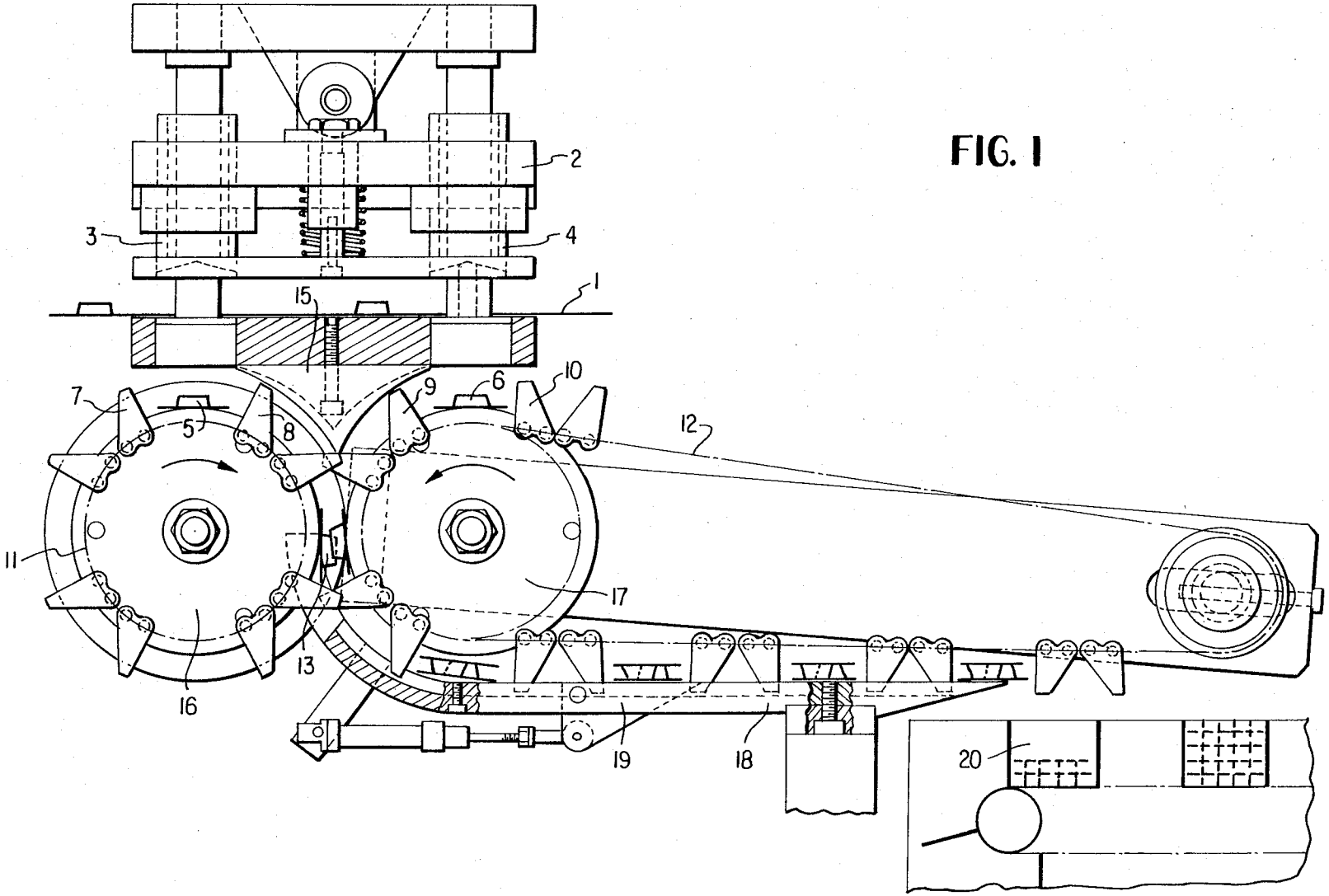
FIG. 1 is an elevational, cross-sectional view of the parts of interest in a packaging machine for implementing the method according to the invention.
Figure 2A:
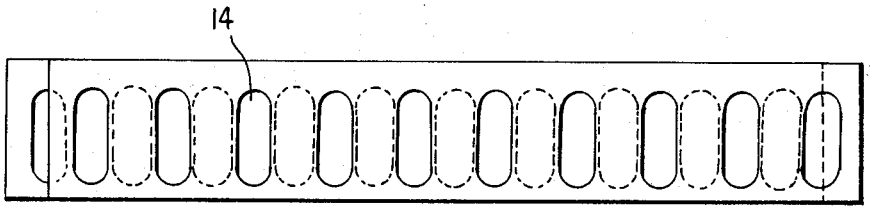
Figure 2B:
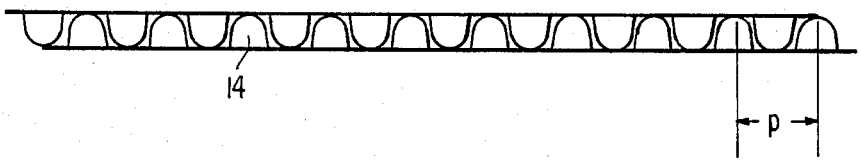
Figure 3A:
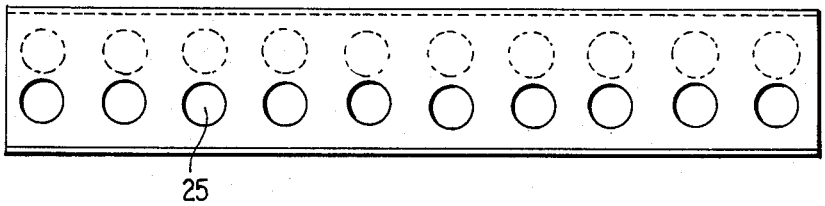
Figure 3B:
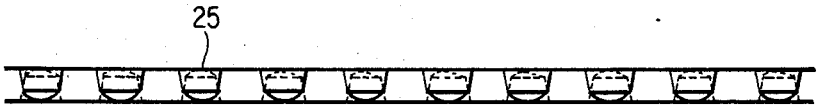

FIG. 1 is a sectional view of that part of a packaging machine which is of importance for an understanding of the present invention. A foil strip 1 filled with packaged products and composed of foils which have been welded together reaches a cutting unit 2 where two bubble strips 5 and 6 are cut by cutting tools 3 and 4 in a single process step and fall between the grippers 7, 8 and 9, 10, respectively, of two conveying and gripping chains 11 and 12 associated with conveyor wheels 16 and 17. During the timed advance or during the rotating process performed by the conveying and gripping chains 11, 12, while the first 90° rotation of each strip is performed, the two cut-out bubble strips 5 and 6 are shifted with respect to one another by a guide sheet (not shown) so that they are offset from one another in length by one-half a single package dimension, thus permitting the two bubbles to be pushed into one another, i.e. to be nested, when they meet at point 13.

FIG. *2a* is a top plan view and FIG. *2b* is a side view of two nested bubble strips each containing oblong tablets 14 packaged in deep-drawn individual packages with their long dimensions perpendicular to the length of the strips. The overall height and width of the two nested bubble strips correspond approximately to the height and width of an individual bubble strip while the overall length of the two nested strips exceeds that of a single strip by an amount equal to one-half of the dimension, p, of a single package in the direction of the length of the strips.

For pills or similar circular products, the abovementioned guide sheet is removed so that the two bubbles come to lie above one another while being coextensive in length. FIGS. *3a* and *3b* show a top plan view and a side view, respectively, of two nested bubble strips which contain pills 25 as the packaged product.

Reverting to FIG. 1, a segment piece 15 prevents ejection of the bubble strip 5 from the conveyor and gripper chain 11 toward the right during the timed rotation of the wheel 16 or of grippers 7 and 8, and of strip 6 toward the left during rotation of wheel 17 and grippers 9 and 10.

The drive unit employed is a stepping gear mechanism so that accurate positioning is assured for the wheels and gripper chains.

After nesting, the two strips 5 and 6 are carried by grippers 9 and 10 along a curved guide path. Before being boxed, the nested bubble strips pass over slide rail 18 where bubble strips which had been marked for rejection during prior testing for perfect filling are rejected in pairs by opening of a flap 19.

At the end of the transporting chain, the nested bubble strips are transferred into boxes 20 of the boxing machine. The number of nested strips to be placed in each box is set at a counter which responds to delivery of each pair of nested strips. When the desired number is reached, the boxing machine is advanced by one step in response to a pulse from the counter.

It will be understood that the above description of the present invention is susceptible to various modifications, changes and adaptations, and the same are intended to be comprehended within the meaning and range of equivalents of the appended claims.

What is claimed is:

1. A machine for cutting a band containing individually packaged products into identical bubble strips each containing a plurality of the individually packaged products disposed at regular intervals along the strip and protruding transversely from one side of the strip, and for assembling such strips, said machine comprising: two cutting units disposed for simultaneously cutting two such bubble strips from the band; and a transporting device for moving said cut strips with a timed advance and disposed for receiving the two simultaneously cut strips from said cutting units, said transporting device comprising means for orienting the two strips relative to one another such that the packaged products on each strip protrude toward the other strip and the packaged products on one strip are offset from the packaged products on the other strip, and means for pushing the two strips, after they have been so oriented, toward one another such that the products of one strip are adjacent those of the other strip and the strips are nested together.

2. A machine as defined in claim 1 further comprising: a station for rejecting two nested strips if either strip is incompletely filled; and means for conveying nested strips from said transporting device and through said station to a location for insertion in a box.

* * * * *